US012649636B2

(12) United States Patent
Oishi et al.

(10) Patent No.: US 12,649,636 B2
(45) Date of Patent: Jun. 9, 2026

(54) MEDIUM TRANSPORT DEVICE AND MEDIUM PROCESSING APPARATUS USING THE SAME

(71) Applicant: FUJIFILM Business Innovation Corp., Tokyo (JP)

(72) Inventors: Ryuga Oishi, Kanagawa (JP); Hiroyuki Tamai, Kanagawa (JP); Ryosuke Yamaji, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 46 days.

(21) Appl. No.: 18/164,628

(22) Filed: Feb. 6, 2023

(65) Prior Publication Data

US 2024/0101377 A1 Mar. 28, 2024

(30) Foreign Application Priority Data

Sep. 27, 2022 (JP) ..... 2022-154042

(51) Int. Cl.
*B65H 5/26* (2006.01)
*B65H 5/06* (2006.01)

(52) U.S. Cl.
CPC ..... *B65H 5/26* (2013.01); *B65H 5/062* (2013.01); *B65H 2403/514* (2013.01);
(Continued)

(58) Field of Classification Search
CPC ..... B65H 5/062; B65H 5/26; B65H 2403/51; B65H 2403/511; B65H 2403/512;
(Continued)

(56) References Cited

U.S. PATENT DOCUMENTS 7,523,933 B2 * 4/2009 Linder ..... B65H 5/062 271/274
2005/0184455 A1 * 8/2005 Youn ..... B65H 5/06 271/274

(Continued)

FOREIGN PATENT DOCUMENTS

JP 2001201976 7/2001

*Primary Examiner* — Prasad V Gokhale
(74) *Attorney, Agent, or Firm* — JCIPRNET

(57) ABSTRACT

A medium transport device includes: a first transport unit that is provided in a first transport path, and nips and transports a medium by a pair of rotating bodies; a second transport unit that is provided in a second transport path different from the first transport path, and nips and transports a medium by a pair of rotating bodies; a first rotation drive unit that rotationally drives the pair of rotating bodies of the first transport unit; a second rotation drive unit that rotationally drives the pair of rotating bodies of the second transport unit; and a pressure contact force adjustment unit that is provided in at least one of the first transport unit or the second transport unit, and adjusts a pressure contact force of the pair of rotating bodies. When one of the first transport unit or the second transport unit nips and transports the medium, the pressure contact force adjustment unit adjusts the pressure contact force of the one transport unit that nips and transports the medium by utilizing a drive source of a rotation drive unit that provides no driving force for transporting the medium to the first transport unit or the second transport unit.

20 Claims, 10 Drawing Sheets

(52) U.S. Cl.
CPC .. *B65H 2403/72* (2013.01); *B65H 2404/1441* (2013.01); *B65H 2404/1451* (2013.01); *B65H 2511/13* (2013.01); *B65H 2515/34* (2013.01)

(58) Field of Classification Search
CPC ..... B65H 2403/514; B65H 2403/72; B65H 2404/144; B65H 2404/1441; B65H 2404/1451; B65H 2511/13; B65H 2515/34
See application file for complete search history.

(56) References Cited

U.S. PATENT DOCUMENTS

| | | | | |
|---|---|---|---|---|
| 2007/0029725 | A1* | 2/2007 | Marx | B65H 5/06 271/272 |
| 2008/0157465 | A1* | 7/2008 | Matsumoto | B65H 5/062 271/277 |
| 2016/0103412 | A1* | 4/2016 | Sato | G03G 15/6576 271/273 |

* cited by examiner

MEDIUM TRANSPORT DEVICE AND MEDIUM PROCESSING APPARATUS USING THE SAME

CROSS-REFERENCE TO RELATED APPLICATIONS

This application is based on and claims priority under 35 USC 119 from Japanese Patent Application No. 2022-154042 filed Sep. 27, 2022.

BACKGROUND

(i) Technical Field

The present disclosure relates to a medium transport device that transports media with different thicknesses, and a medium processing apparatus that uses the medium transport device.

(ii) Related Art

As this type of medium transport device, for example, the medium transport device described in Japanese Unexamined Patent Application Publication No. 2001-201976 has been already known. Japanese Unexamined Patent Application Publication No. 2001-201976 (Detailed Description, FIG. 1) disposes an aspect in which a fixing device fixes an image by nipping and transporting an image carrying recording medium with a pressure-contact nip of rotating bodies which are brought in pressure-contact with each other by a pressurizing unit, the fixing device including a pressure force adjustment unit that changes a pressure force of the pressurization unit. The pressure force adjustment unit is driven by a drive source that drives the rotating bodies.

SUMMARY

Aspects of non-limiting embodiments of the present disclosure relate to a medium transport device and a medium processing apparatus using the medium transport device that, in order to achieve transport of each of media with different thicknesses, are capable of adjusting a nip pressure for nipping the medium concurrently with a transport operation of the medium without temporarily stopping the medium.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a medium transport device including: a first transport unit that is provided in a first transport path, and nips and transports a medium by a pair of rotating bodies; a second transport unit that is provided in a second transport path different from the first transport path, and nips and transports a medium by a pair of rotating bodies; a first rotation drive unit that rotationally drives the pair of rotating bodies of the first transport unit; a second rotation drive unit that rotationally drives the pair of rotating bodies of the second transport unit; and a pressure contact force adjustment unit that is provided in at least one of the first transport unit or the second transport unit, and adjusts a pressure contact force of the pair of rotating bodies, wherein when one of the first transport unit or the second transport unit nips and transports the medium, the pressure contact force adjustment unit adjusts the pressure contact force of the one transport unit that nips and transports the medium by utilizing a drive source of a rotation drive unit that provides no driving force for transporting the medium to the first transport unit or the second transport unit.

BRIEF DESCRIPTION OF THE DRAWINGS

Exemplary embodiments of the present disclosure will be described in detail based on the following figures, wherein.

DETAILED DESCRIPTION

Outline of Exemplary Embodiment

Figure 1:
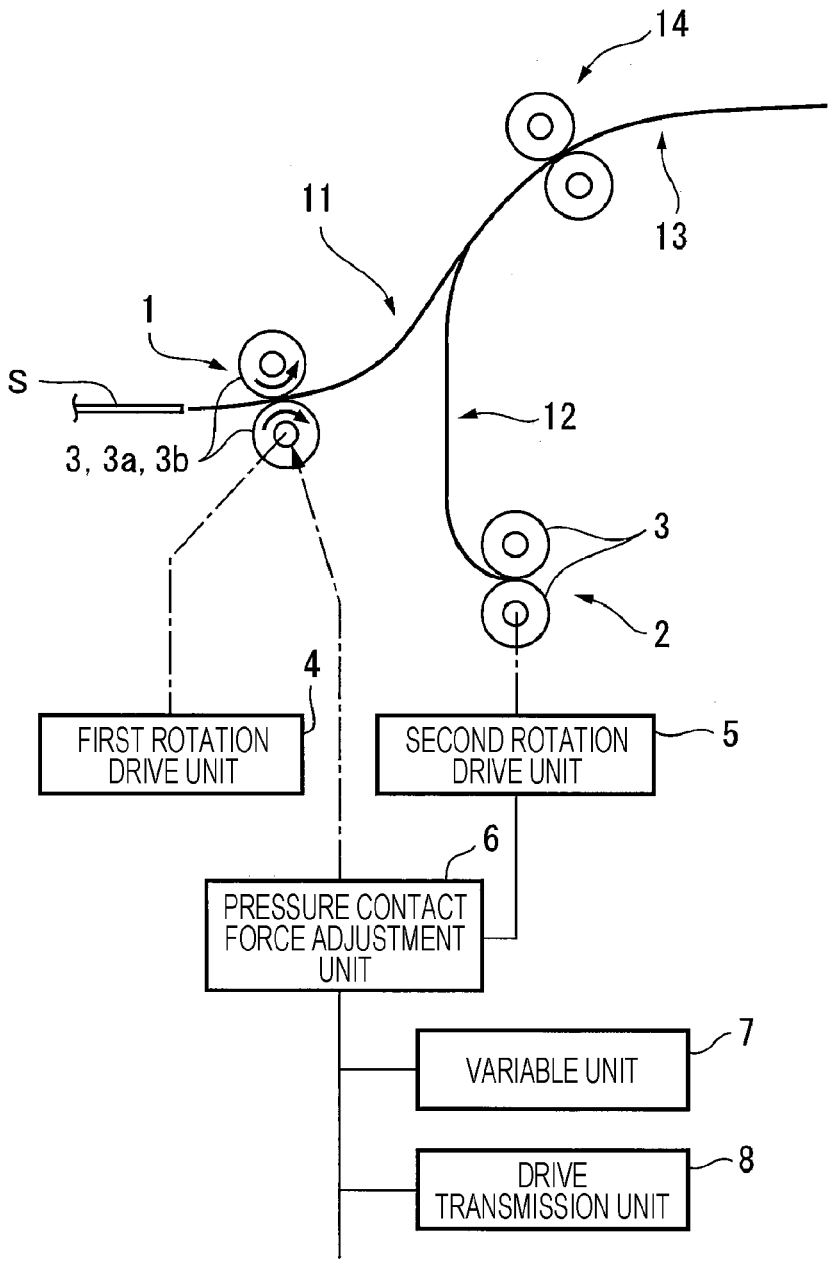
FIG. 1 is an explanatory view illustrating an outline of an exemplary embodiment of a medium transport device to which the present disclosure is applied.

FIG. 1 is an explanatory view illustrating an outline of an exemplary embodiment of a medium transport device to which the present disclosure is applied.

In FIG. 1, the medium transport device includes: a first transport unit 1 that is provided in a first transport path 11, and nips and transports a medium S by a pair of rotating bodies 3 (3*a*, 3*b*); a second transport unit 2 that is provided in a second transport path 12 different from the first transport path 11, and nips and transports a medium S by a pair of rotating bodies 3 (3*a*, 3*b*); a first rotation drive unit 4 that rotationally drives the pair of rotating bodies 3 of the first transport unit 1; a second rotation drive unit 5 that rotationally drives the pair of rotating bodies 3 of the second transport unit 2; and a pressure contact force adjustment unit 6 that is provided in at least one of the first transport unit 1 or the second transport unit 2, and adjusts a pressure contact force of the pair of rotating bodies 3. When one of the first transport unit 1 or the second transport unit 2 nips and transports the medium S, the pressure contact force adjustment unit 6 adjusts the pressure contact force of the one transport unit (for example, the first transport unit 1 in FIG. 1) that nips and transports the medium S by utilizing a drive source of a rotation drive unit (for example, the second rotation drive unit 5 in FIG. 1) that provides no driving force for transporting the medium S to the first transport unit 1 or the second transport unit 2.

Note that FIG. 1 illustrates the situation when the first transport unit 1 is rotationally driven; however, for example, when the second transport unit 2 is rotationally driven, the pressure contact force adjustment unit 6 may adjust the pressure contact force of the second transport unit 2 by utilizing the drive source of the first rotation drive unit 4 that provides no driving force for transporting the medium S to the first transport unit 1.

This type of medium transport device is incorporated in a medium processing apparatus including a processing unit (not illustrated) that performs a predetermined process on the medium S, and is used as an apparatus that implements the functions of transporting the medium S to the processing unit or transporting the medium S processed by the processing unit.

Note that the processing unit referred to herein broadly includes, in addition to an imaging unit that forms an image on the medium S, units that perform various types of processes, such as a hole punching process, a cutting process, a sorting process, and a folding process on the medium S.

In such a technical unit, when a medium is transported by the first transport unit 1 or the second transport unit 2, it is sufficient that a medium in which wrinkles may occur be defined as a thin medium S, and for example, a medium weighing 60 gsm or less may be selected as appropriate as the thin medium S.

Each of the first transport unit 1, and the second transport unit 2 may include a pair of rotating bodies 3 (3*a*, 3*b*). The rotating bodies 3 include each of a roll-shaped member, a belt-shaped member, and may be a combination of a roll-shaped member and a belt-shaped member. Also, the pair of rotating bodies 3 may be such that one rotating body works as a drive rotating body, and the other rotating body is formed as a driven rotating body that comes into contact with the drive rotating body and is driven to rotate.

In addition, the first transport path 11 and the second transport path 12 may be separate transport paths, and the aspects of the transport paths 11, 12 include not only an aspect in which the transport paths are merged on the way, but also an aspect in which the transport paths are not merged. Furthermore, the first rotation drive unit 4, and the second rotation drive unit 5 may rotationally drive the pair of rotating bodies 3, and typically include a drive source, and a drive transmission system that transmits a driving force from the drive source to each drive rotating body.

In addition, the pressure contact force adjustment unit 6 may be provided in one of the first transport unit 1 or the second transport unit 2, or provided in both. For adjustment of the pressure contact force, an appropriate pressure contact force may be experimentally determined for the thickness of the medium S, and a pressure contact force selection table may be created, by which an appropriate pressure contact force can be selected according to the type of the medium S.

In the pressure contact force adjustment unit 6, the timing of adjusting the pressure contact force of the transport unit (the first transport unit 1 or the second transport unit 2) that nips and transports the medium S is not limited to a time during the operation of directly transporting the medium S, and also includes a time before the start of the transport operation for the medium S.

Next, a representative aspect or an exemplary aspect of the medium transport device according to the exemplary embodiment will be described.

First, as a representative aspect of the pressure contact force adjustment unit 6, the following aspect may be mentioned, in which when the medium S is a thin medium with a predetermined thickness or less, the pressure contact force is adjusted to be lower than the pressure contact force for a medium other than thin medium. This is because if the pressure contact force is adjusted to the same for a thin medium and a medium other than the thin medium, wrinkles likely occur in the thin medium, which should be tried to be avoided.

In addition, as a representative aspect of the pressure contact force adjustment unit 6, the following aspect may be mentioned, in which the pressure contact force is adjusted after the pair of rotating bodies 3 start rotational drive. This example shows an aspect in which the pressure contact force does not need to be adjusted before the rotational drive of the first transport unit 1 or the second transport unit 2.

Furthermore, as an exemplary aspect of the pressure contact force adjustment unit 6, both pressure contact forces of the first transport unit 1 and the second transport unit 2 are adjusted. In this example, each of the first transport path 11, and the second transport path 12 is capable of transporting a thin medium with an appropriate pressure contact force.

In addition, as another exemplary aspect of the pressure contact force adjustment unit 6, the following aspect may be mentioned, in which a nip release operation to nip and release the pair of rotating bodies 3 is performed between a contact position and a non-contact position. In this example, in addition to adjustment of the pressure contact force of the pair of rotating bodies 3 of the first transport unit 1 or the second transport unit 2 in a contact state, it is also possible to retreat the pair of rotating bodies 3 to a non-contact position to temporarily release the contact state.

Furthermore, as an exemplary configuration example of the pressure contact force adjustment unit 6, the following aspect may be mentioned, in which the pressure contact force adjustment unit 6 has: a variable unit 7 that is provided in the first transport unit 1 or the second transport unit 2, and changes the pressure contact force; and a drive transmission unit 8 that transmits, to the variable unit 7, a drive source of the rotation drive unit (for example, the second rotation drive unit 5 in FIG. 1) that provide no driving force for transporting the medium S to the first transport unit or the second transport unit.

As a representative aspect of the pressure contact force adjustment unit 6 of this example, the following aspect may be mentioned, in which the drive transmission unit 8 has a rotational component to be rotated by a drive source, and the variable unit 7 changes the pressure contact force with a cam member that rotates by following the rotational component.

In addition, as a representative aspect of this example, the following aspect may be mentioned, in which the first rotation drive unit 4 or the second rotation drive unit 5 has the drive source that is normally and reversely rotatable, and the drive transmission unit 8 includes an intermittently coupling component that, when the drive source of the first rotation drive unit 4 or the second rotation drive unit 5 drives in reverse rotation, transmits a driving force accompanying the drive in reverse rotation to the variable unit 7.

In addition, as the layout of the medium transport device, the following aspect may be mentioned, which includes a positioning unit 14 that positions the medium S on a third transport path 13 after the first transport path 11 and the second transport path 12 are merged downstream in a transport direction of the medium S. In this example, since the first transport unit 1 or the second transport unit 2 needs the nip release operation to position the medium S, in addition to pressure contact force adjustment to the pair of rotating bodies 3, the nip release operation may be made possible for the pair of rotating bodies 3.

Hereinafter the present disclosure will be further described in detail based on the exemplary embodiment shown in the accompanying drawings.

Exemplary Embodiment 1

Figure 2:
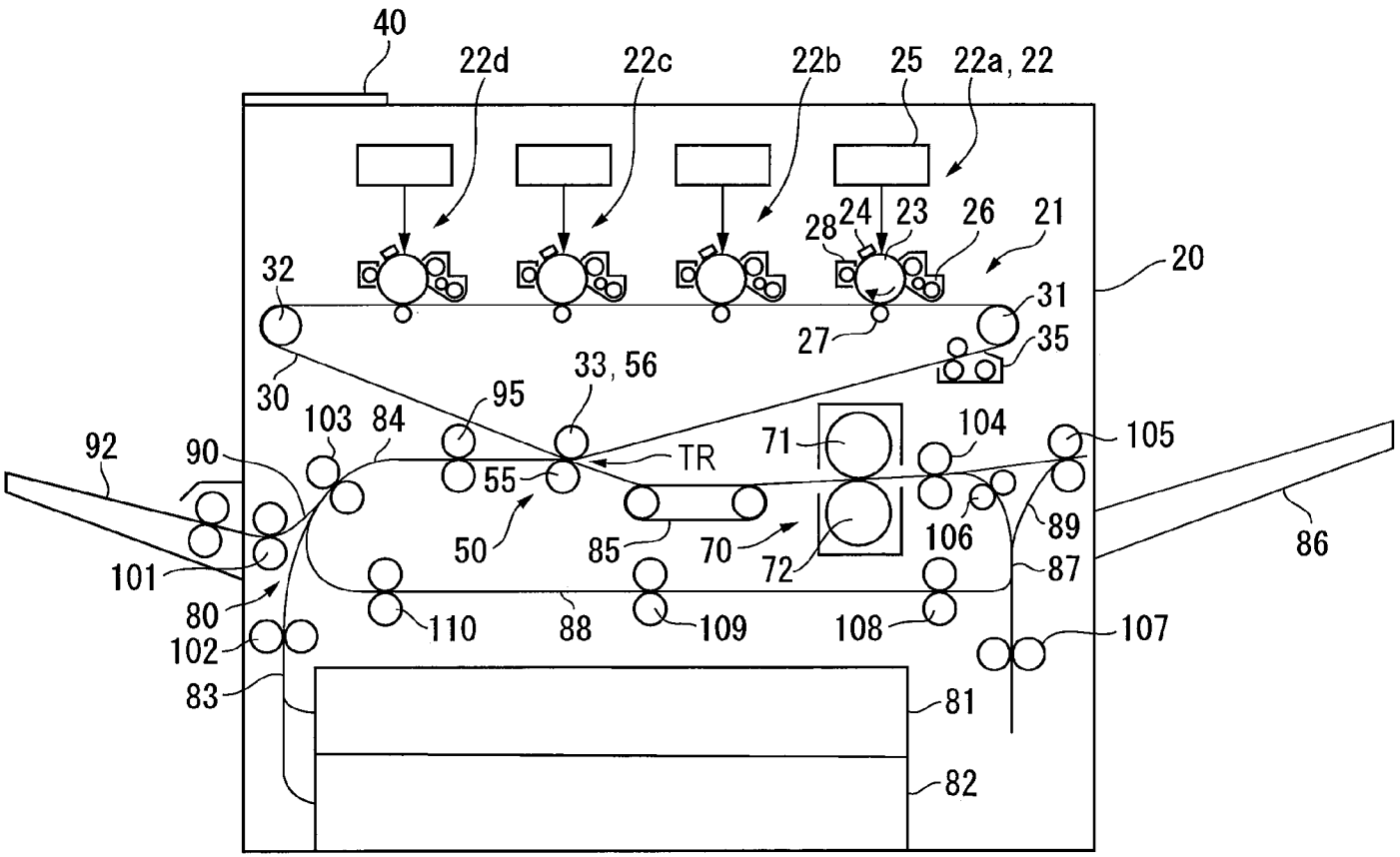
FIG. 2 is an explanatory view illustrating the entire configuration of an image forming apparatus as a medium processing apparatus according to Exemplary Embodiment 1.

FIG. 2 is an explanatory view illustrating the entire configuration of an image forming apparatus as a medium processing apparatus according to Exemplary Embodiment 1.

—Entire Configuration of Image Forming Apparatus—

In FIG. 2, the basic configuration of the image forming apparatus is such that for example, an imaging engine 21 to produce multiple color component images is equipped in an apparatus housing 20, and a medium transport system 80 to transport a medium to the imaging engine 21, and a fixing device 70 to fix an image produced by the imaging engine 21 onto a medium are provided below the imaging engine 21.

In this example, the imaging engine 21 includes: an image formers 22 (specifically 22a to 22*d*) that form an image having multiple color components (yellow (Y), magenta (M), cyan (C), black (K) in the exemplary embodiment); a belt-shaped intermediate transfer body 30 that causes successive transfer (first transfer) of a color component image formed by each image former 22 and carries the image; and a second transfer device (collective transfer device) 50 that second transfers (collectively transfers) each color component image transferred on the intermediate transfer body 30 onto a medium (a sheet of paper or a film). Note that a symbol 40 in FIG. 2 indicates an operation panel to operate the image forming apparatus.

—Image Forming Apparatus—

In the exemplary embodiment, the image formers 22 (22*a* to 22*d*) have respective drum-shaped photoreceptors 23, and in the periphery of each photoreceptor 23, the following devices are disposed: a charging device 24 such as a corotron and a transfer roll, which charges the photoreceptor 23; an exposure device 25 such as a laser scanning device, which writes an electrostatic latent image on the photoreceptor 23 charged; a developing device 26 which develops the electrostatic latent image written on the photoreceptor 23 with YMCK color component toner; and a photoreceptor cleaning device 28 which removes residual toner on the photoreceptor 23, and a first transfer device 27 such as transfer roll, by which a toner image on the photoreceptor 23 is transferred to the intermediate transfer body 30.

Also, the intermediate transfer body 30 is wound around multiple (three in the exemplary embodiment) tension rolls 31 to 33, and for example, the tension roll 31 is used as a drive roll which is driven by a drive motor (not illustrated), and the intermediate transfer body 30 is circularly moved by the drive roll. Furthermore, an intermediate transfer body cleaning device 35 is provided between the tension rolls 31, 33 to remove residual toner on the intermediate transfer body 30 after second transfer.

—Second Transfer Device (Collective Transfer Device)—

In addition, a second transfer device (collective transfer device) 50 is, for example, such that a transfer roll 55 is disposed in pressure contact with the tension roll 33 at a position opposed thereto in the intermediate transfer body 30, and the tension roll 33 for the intermediate transfer body 30 serves as an opposed roll 56 that is the opposed electrode of the transfer roll 55. In this example, the transfer roll 55 is configured to be covered by an elastic layer around a shaft made of metal, the elastic layer being a urethane foam rubber or EPDM mixed with carbon black. A transfer voltage from a transfer power supply (not illustrated) is applied to the opposed roll 56 (also used as the tension roll 33 in this example) via a conductive power supply roll (not illustrated), and meanwhile, a predetermined transfer electric field is generated between the transfer roll 55 and the opposed roll 56 by grounding the transfer roll 55, and a nip area of the intermediate transfer body 30, nipped between the transfer roll 55 and the opposed roll 56 functions as a second transfer region (collective transfer region) TR. Note that although an aspect is provided in which the transfer roll 55 is used in the second transfer device 50, the present disclosure is not limited to this, and it is needless to say that a transfer belt module may be used in which a transfer belt is wound on the transfer roll 55 as one of tension rolls.

—Fixing Device—

A fixing device 70 has a drive rotatable heat fixing roll 71 that comes into contact with and disposed on an image carrying surface of a medium; and a pressure fixing roll 72 that is disposed in pressure contact with and opposed to the heat fixing roll 71, and rotates by following the heat fixing roll 71, where an image carried on a medium is passed through a fixing area between both fixing rolls 71, 72, and the image is heat and pressure fixed.

In the heat fixing roll 71, for example, a heater is incorporated in the roll body, or an external heater is brought into contact with the outer peripheral surface of the roll body so that the roll body is heated, and it is needless to say that a heater may be added to the pressure fixing roll 72 as needed. Note that this example shows a roll pair configuration example; however, without being limited to this, appropriate selection may be made, for example, the heat fixing roll 71 is comprised of a heat fixing belt using an induction heating system.

—Medium Transport System—

In addition, the medium transport system 80 has multiple (two in this example) medium supply containers 81, 82, and a medium supplied from one of the medium supply containers 81, 82 is transported from a vertical transport path 83 extending in an approximately vertical direction to the second transfer region TR through a horizontal transport path 84 extending in an approximately horizontal direction, and subsequently, the medium carrying a transferred image passes through a transport belt 85, and reaches a fixing area used by the fixing device 70, and is discharged to a medium discharge tray 86 provided on the side of the apparatus housing 20.

Furthermore, the medium transport system 80 has a reversable branched transport path 87 which is branched down from a portion of the horizontal transport path 84, the portion being located downstream of the fixing device 70 in the medium transport direction, and a medium reversed by the branched transport path 87 is returned from the vertical transport path 83 to the horizontal transport path 84 again through a return transport path 88, then an image is transferred to the reverse side of the medium at the second transfer region TR, and is discharged to the medium discharge tray 86 through the fixing device 70. Note that the branched transport path 87 is provided with a branch return transport path 89 which is branched on the way and transports a reversed medium to the medium discharge tray 86.

In addition, on the opposite side of the apparatus housing 20 from the medium discharge tray 86, a side transport path 90 is provided toward the horizontal transport path 84 to be merged with the vertical transport path 83, and an end of the side transport path 90 is provided with a manual feed medium supply unit 92 by which a manually fed medium can be supplied.

Then position alignment rolls 95 are provided as positioning units forward of the second transfer region TR of the horizontal transport path 84 to align the position of a medium, and supply the medium to the second transfer region TR, and in addition, the transport paths 83, 84, 87 to 90 are provided with an appropriate number of transport rolls 101 to 110 as transport units.

—Necessity of Measures Against Paper Wrinkles—

In this type of image forming apparatus, there is a demand that sheets of paper (from thick paper to thin paper) with different thicknesses be broadly used as media. In such a demand, for example, when a medium weighing 80 gsm or less, particularly, a medium weighing 60 gsm or less is used, there is concern about the occurrence of paper wrinkles.

Here, the cause of the occurrence of paper wrinkles is discussed: at the time of transport of thin paper, paper wrinkles occur due to, for example, a slight difference between the outer diameters at axial both ends of transport rolls consisting of a pair of roll members, thus in order to transport thick paper other than thin paper, a technique is used to set a higher transport force (corresponding to a pressure contact force) by transport rolls so that thick paper is appropriately handled, and when thin paper is used, there is concern about the occurrence of paper wrinkles due to a higher pressure in a contact area accompanying the transport force by transport rolls.

A technique to prevent the occurrence of paper wrinkles by adding an adjustment mechanism to adjust a transport force according to sheets of paper with different thicknesses has been already proposed. In addition, a model that copes with paper wrinkles by tuning a medium transport device for exclusive use of thin paper as individual coping has been already proposed.

However, in order to take the former measures, various components such as a motor and a sensor are needed to introduce an adjustment mechanism for transport force, thus the configuration becomes complicated and the number of components increases, and additionally, it is necessary to secure the space to install the adjustment mechanism. Thus, although it is possible to introduce this type of adjustment mechanism to a relatively large high-performance model, it is difficult to introduce the adjustment mechanism to a less expensive and small model.

Also, in the latter measures, when tuning of the medium transport device is performed as individual coping to cope with thin paper, thick paper transport performance is reduced significantly, and not only thick paper transport becomes difficult, but also a repair work by a specialized worker may be additionally needed.

Thus, in the exemplary embodiment, based on the configuration example of an existing medium transport device, adoption of a method to implement both a simple configuration and transport performance of media with different thicknesses has been discussed.

—Basic Configuration of Medium Transport Device—

Figure 3:
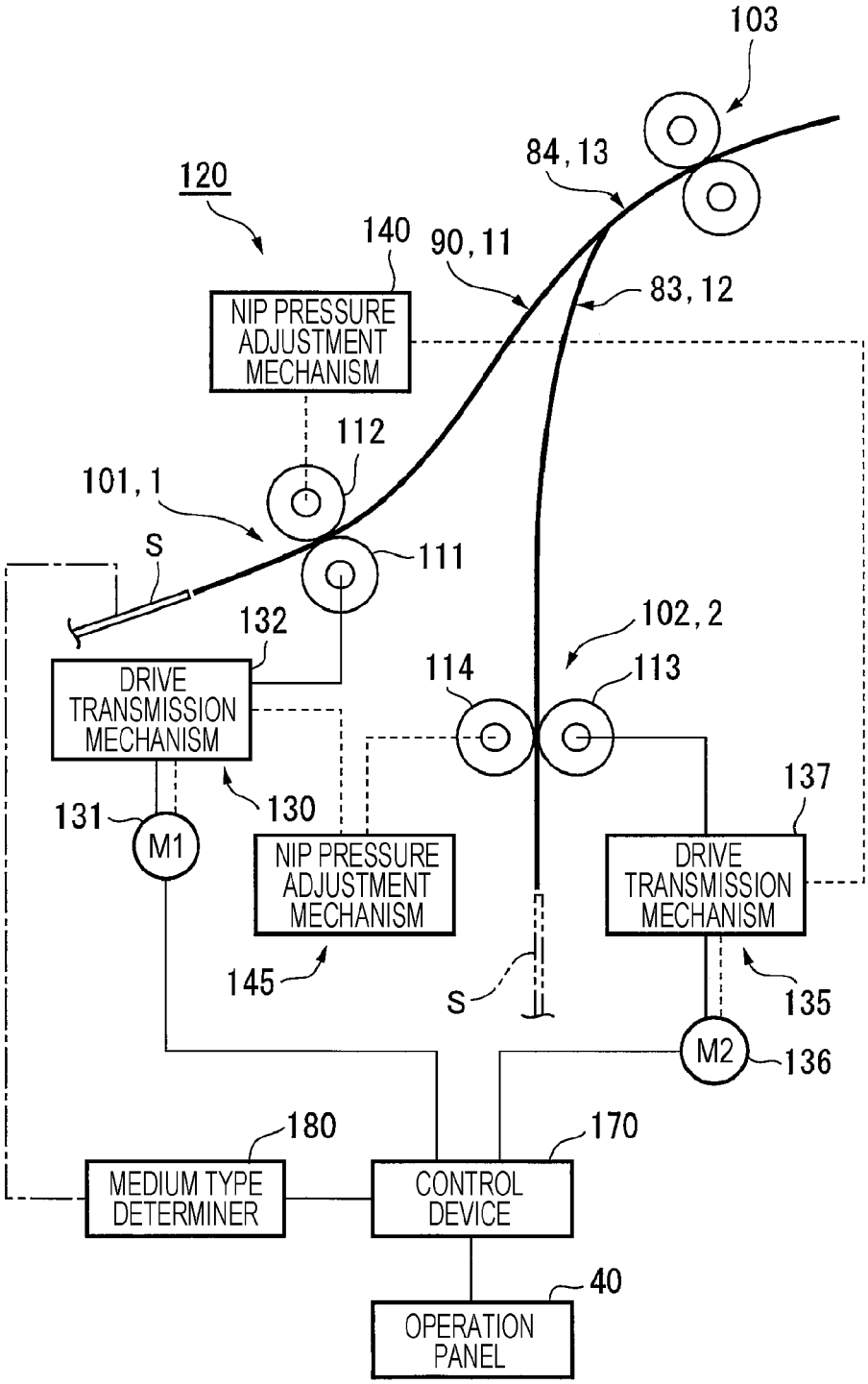
FIG. 3 is an explanatory view illustrating the medium transport device used in Exemplary Embodiment 1 and its periphery.

In this example, as illustrated in FIG. 2 and FIG. 3, a position where paper wrinkles are likely to occur in thin paper is predicted, and a medium transport device 120 is provided at the position where the side transport path 90 as the first transport path 11 and the vertical transport path 83 as the second transport path 12 are merged and connected to the horizontal transport path 84.

That is, the medium transport device 120 includes transport rolls 101 as the first transport unit 1 provided in the side transport path 90, and transport rolls 102 as the second transport unit 2 provided in the vertical transport path 83.

In this example, the transport rolls 101 include, as a pair of rotating bodies, a drive roll 111 having a roll body in the periphery of a rotational shaft made of metal, and a driven roll 112 having a roll body in the periphery of a rotational shaft made of metal to come into contact with the drive roll 111 and to be driven to rotate, and a contact area (nip area) to hold the medium S is formed between the drive roll 111 and the driven roll 112. Here, each roll body is such that a cylindrical elastic body such as polyurethane rubber is layered on the periphery of the rotational shaft, and the surface of the elastic body is covered with a protective layer (such as a release layer composed of a fluorinated resin).

In addition, the transport rolls 102 are also configured in substantially the same manner, and include a drive roll 113 and a driven roll 114 as a pair of rotating bodies.

Furthermore, the medium transport device 120 includes: a first rotational drive mechanism 130 as a first rotation drive unit to rotationally drive the transport rolls 101; a second rotational drive mechanism 135 as a second rotation drive unit to rotationally drive the transport rolls 102; a nip pressure adjustment mechanism 140 to adjust the nip pressure (corresponding to the pressure contact force to nip the medium S) of the contact area of the transport rolls 101; and a nip pressure adjustment mechanism 145 to adjust the nip pressure of a contact area of the transport rolls 102.

—Configuration Example of Rotational Drive Mechanism—

In this example, the first rotational drive mechanism 130 includes: a normally and reversely rotatable drive motor 131 (denoted as M1 in FIG. 3) that drives to rotate the drive roll 111 of the transport rolls 101; and a drive transmission mechanism 132 that transmits the normal rotation driving force of the drive motor 131 to the drive roll 111 of the transport rolls 101. In approximately the same manner as the first rotational drive mechanism 130, the second rotational drive mechanism 135 includes: a normally and reversely rotatable drive motor 136 (denoted as M2 in FIG. 3) that drives to rotate the drive roll 113 of the transport rolls 102; and a drive transmission mechanism 137 that transmits the normal rotation driving force of the drive motor 136 to the drive roll 113 of the transport rolls 102.

Figure 4A:
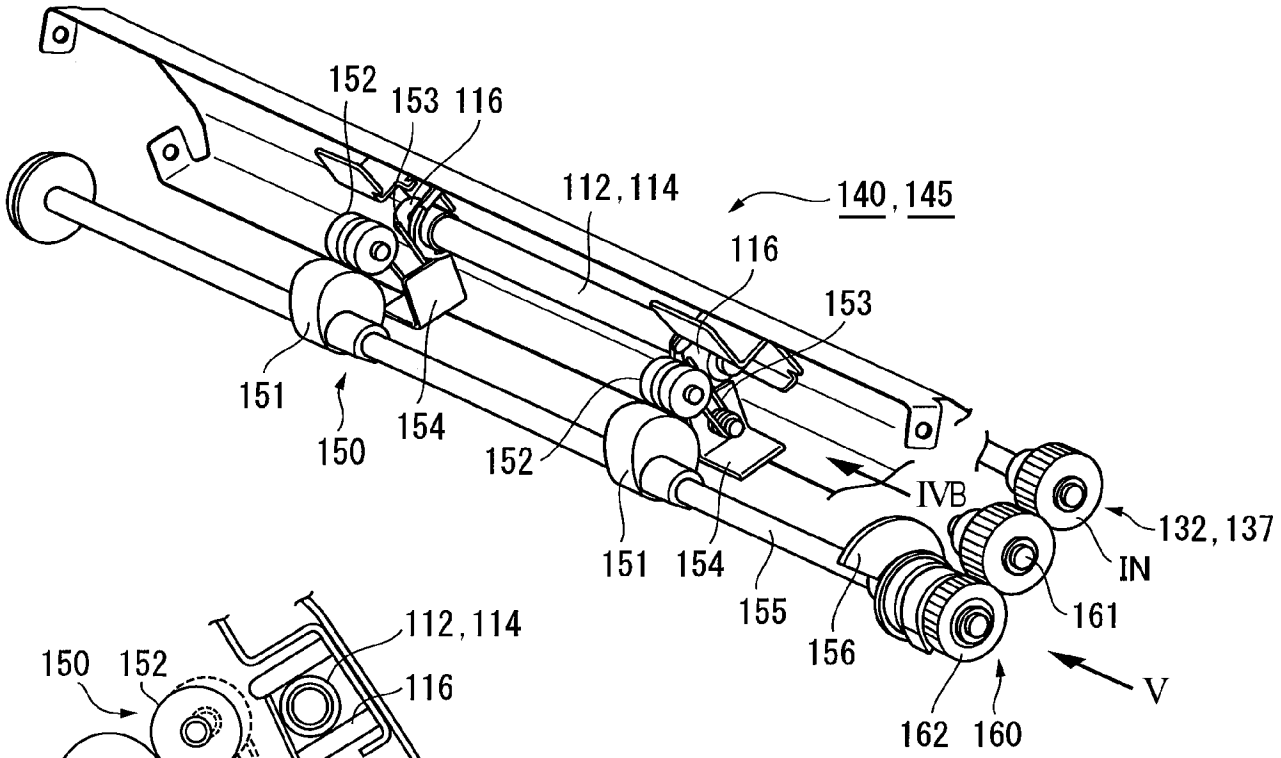
FIG. 4A is an explanatory view illustrating an example of a drive transmission mechanism and a nip pressure adjustment mechanism which are used in Exemplary Embodiment 1.
Figure 4B:
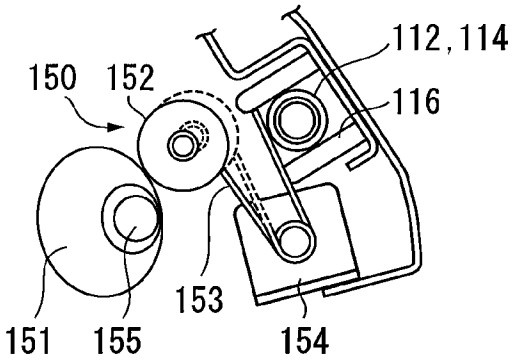
FIG. 4B is an arrow view from direction IVB.
Figure 5A:
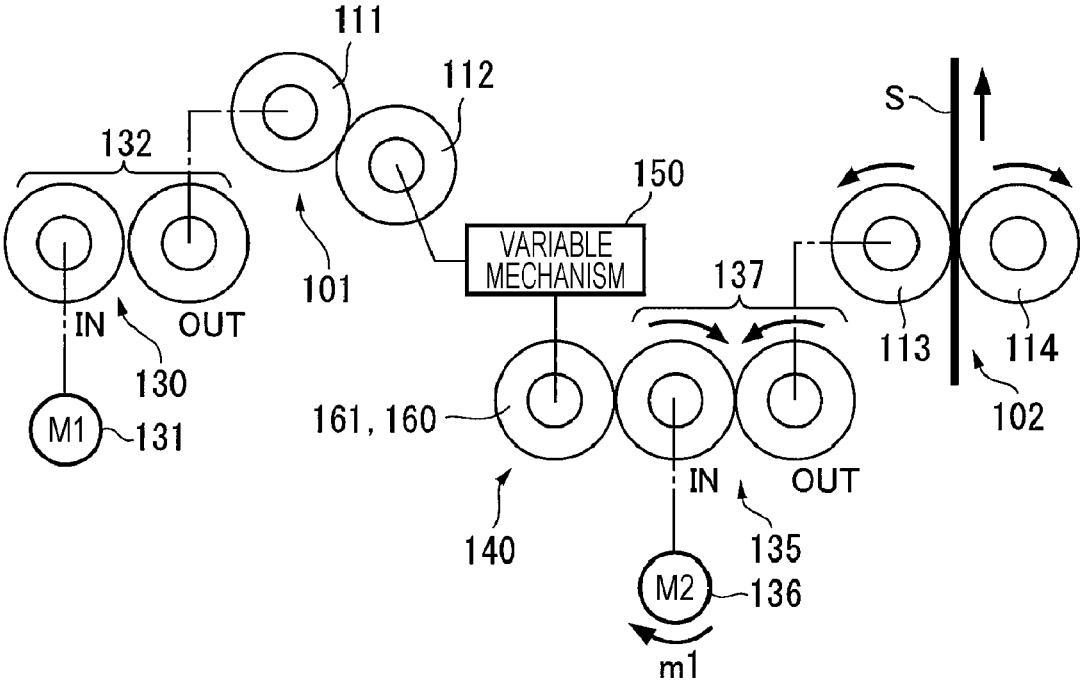
FIG. 5A is an arrow view as seen from direction V in FIG. 4A, and an explanatory view illustrating the behavior of the drive transmission mechanism at the time of medium transport.
Figure 5B:
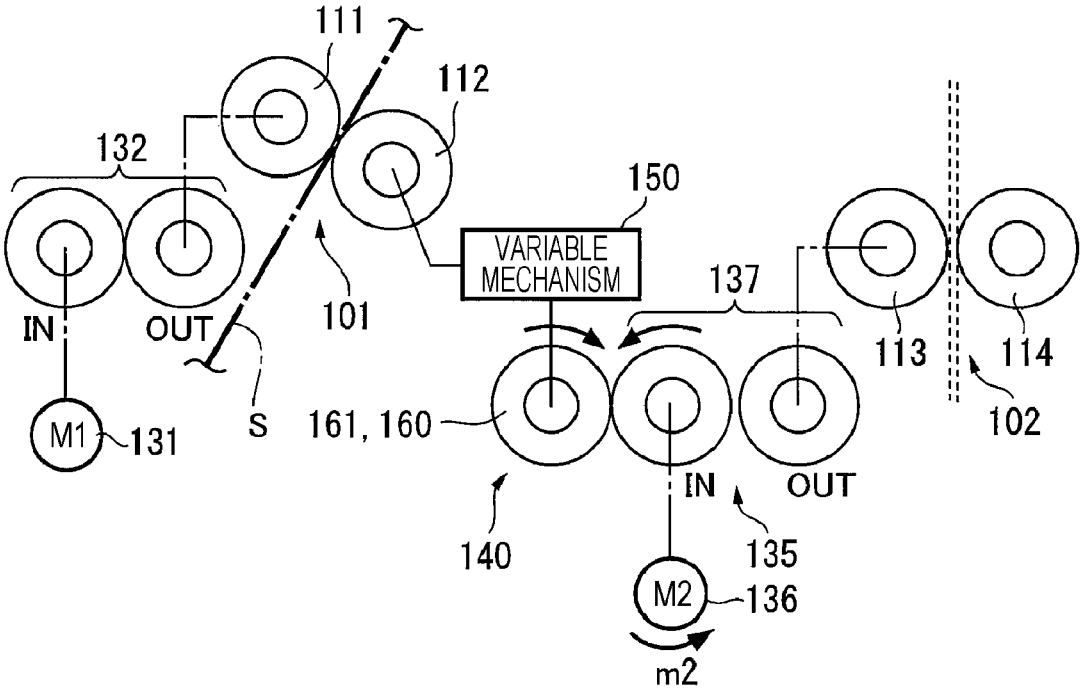
FIG. 5B is an explanatory view illustrating the behavior of the drive transmission mechanism and the nip pressure adjustment mechanism at the time of nip pressure adjustment.

Here, the drive transmission mechanisms 132, 137 are comprised of a drive transmission gear train that transmits the driving force of the drive motors 131, 136 illustrated in FIG. 4A and FIGS. 5A and 5B to the drive rolls 111, 113 of the transport rolls 101, 102. In this example, input-side transmission gears IN of the drive transmission gear train are respectively provided coaxially with the rotational shafts of the drive motors 131, 136, and output-side transmission gears OUT are respectively provided coaxially with the rotational shafts of the drive rolls 111, 113.

—Configuration Example of Nip Pressure Adjustment Mechanism—

In this example, as illustrated in FIGS. 4A and 4B and FIGS. 5A and 5B, the nip pressure adjustment mechanism 140 is provided in the driven roll 112 of the transport rolls 101, and includes: a variable mechanism 150 (corresponding to the variable unit 7 of FIG. 1) that changes the pressure contact force to press the driven roll 112 against the drive roll 111; and a drive transmission unit 160 (corresponding to the drive transmission unit 8 of FIG. 1) that is provided to be connected to the drive transmission mechanism 137 of the second rotational drive mechanism 135 to transmit the driving force of the drive motor 136 of the second rotational drive mechanism 135 of the transport rolls 102 to the variable mechanism 150.

Also, the nip pressure adjustment mechanism 145 is configured in substantially the same manner as the nip pressure adjustment mechanism 140, and when the drive motor 131 of the first rotational drive mechanism 130 drives in reverse rotation, the nip pressure adjustment mechanism 145 transmits a driving force accompanying the drive in reverse rotation to the variable mechanism 150 via the drive transmission unit 160, and adjusts the nip pressure of the transport rolls 102 appropriately.

The variable mechanism 150 includes: disc-shaped eccentric cam members 151 provided as a pair, corresponding to both ends of the driven rolls 112, 114 of the transport rolls 101, 102; roller members 152 provided between the cam members 151 and bearing holders 116 of the driven rolls 112, 114 of the transport rolls 101, 102 to come into contact with the cam peripheral surfaces of the cam members 151 to move forward or backward in a predetermined direction; and urging springs 153 that are retained at a predetermined position via a retaining bracket 154, and provided between the roller members 152 and the bearing holders 116 of the driven roll 112 to urge the roller members 152 against the cam peripheral surfaces of the cam members 151, the variable mechanism 150 being configured to change the position of the bearing holders 116 of the driven roll 112 and change the pressure contact force of the driven roll 112 for the drive roll 111 according to the rotation positions of the cam members 151.

Note that a light blocking plate 156 may be mounted on a rotational shaft 155 of each cam member 151, and the amount of rotation of the cam member 151 may be regulated by an optical sensor (not illustrated) detecting the area of the light blocking plate 156. Alternatively, slits (not illustrated) may be formed every predetermined angle intervals in the light blocking plate 156, multiple amounts of rotation of the cam member 151 may be selected by an optical sensor (not illustrated) that counts the number of slits, and multiple nip pressures may be selected according to the types of media.

As illustrated in FIG. 4A, the drive transmission unit 160 includes: one-way clutch gear 161 as an intermittently coupling component that is engaged with the input-side transmission gear IN of the drive transmission gear train constituting the drive transmission mechanisms 132, 137, and when the input-side transmission gear IN is rotationally driven in the predetermined direction m1, blocks a rotational movement to follow the input-side transmission gear IN, and when the rotation direction of the input-side transmission gear IN is m2 which is opposite to the rotation direction m1, follows the input-side transmission gear IN to rotate, where m1 is the rotation direction of the input-side transmission gear IN when the drive motors 131, 136 are driven in normal rotation; and a transmission gear 162 which is provided coaxially with the rotational shafts of the cam members 151, and engaged with the one-way clutch gear 161 to rotate the cam members 151 according to the rotation of the one-way clutch gear 161.

In an aspect in which the drive transmission unit 160 is provided, as illustrated in FIG. 5A, for example, when the medium S is transported by the transport rolls 102 of the vertical transport path 83 as the second transport path, the drive roll 113 of the transport rolls 102 may be driven in normal rotation through the drive transmission gear train of the drive transmission mechanism 137 by causing the drive motor 136 (denoted as M2 in FIG. 5A) of the second rotational drive mechanism 135 to be driven in normal rotation, and a transport operation of the medium S may be performed by the transport rolls 102.

In this process, the input-side transmission gear IN of the drive transmission gear train rotates in the rotation direction m1, thus the one-way clutch gear 161 of the drive transmission unit 160 does not rotate, and the nip pressure adjustment mechanism 140 is not operated by the drive motor 136.

Since thin paper is to be transported by the transport rolls 101, the nip pressure of the transport rolls 101 needs to meet thin paper specifications. As illustrated in FIG. 5B, when the drive motor 136 of the second rotational drive mechanism 135 is driven in reverse rotation, the input-side transmission gear IN of the drive transmission gear train of the drive transmission mechanism 137 rotates in the rotation direction m2 by a predetermined angle. Then, the one-way clutch gear 161 of the drive transmission unit 160 of the nip pressure adjustment mechanism 140 rotates by following the input-side transmission gear IN, thereby causing the cam members 151 of the variable mechanism 150 to rotate by a predetermined angle via the transmission gear 162. As a result, the pressure contact force of the driven roll 112 for the drive roll 111 is changed according to the rotation position of the cam members 151, and the nip pressure of the transport rolls 101 is adjusted according to thin paper specifications.

In this example, as illustrated in FIG. 5B, the transport rolls 101 receive drive in normal rotation of the drive motor 131 (denoted as M1 in FIG. 5A) of the first rotational drive mechanism 130, thus the drive roll 111 is rotationally driven via the drive transmission gear train of the drive transmission mechanism 132.

On the other hand, as illustrated in FIG. 5B, the transport rolls 101 receive drive in reverse rotation of the drive motor 136 of the second rotational drive mechanism 135, thus the rotational driving force transmitted via the drive transmission mechanism 137 is transmitted to the nip pressure adjustment mechanism 140, and the pressure contact force between the drive roll 111 and the driven roll 112 is changed, and the nip pressure is adjusted according to thin paper specifications.

In this process, the timing of nip pressure adjustment for the transport rolls 101 is before the start of a transport operation of the medium S, and the transport operation of the medium S by the transport rolls 101 may be started. However, even in the middle of a transport operation of the medium S, for example when a medium type is changed, the nip pressure of the transport rolls 101 may be adjusted, and after the adjustment, the transport operation of the medium S may be restarted.

—Control System of Medium Transport Device—

In this example, as illustrated in FIG. 3, the control device 170 is provided, which appropriately positions the media S with different thicknesses and properly transports the media S.

The control device 170 is comprised of a microcomputer including various processors. In the embodiments above, the term "processor" refers to hardware in a broad sense. Examples of the processor include general processors (e.g., CPU: Central Processing Unit) and dedicated processors (e.g., GPU: Graphics Processing Unit, ASIC: Application Specific Integrated Circuit, FPGA: Field Programmable Gate Array, and programmable logic device).

Furthermore, in this example, as illustrated in FIG. 3, a medium type determiner 180 is provided. The medium type determiner 180 includes: a thickness detector that directly detects whether paper as the medium S is thin paper weighting 60 gsm or less, or thick paper other than the thin paper, for example; and a medium specification unit (provided in, for example, the operation panel 40 of FIG. 2) that specifies a medium to be used from a usable medium type table prepared in a memory in the control device 170.

In this example, a needed program such as a "medium transport control program (see FIG. 6, FIG. 7)" is preinstalled in a memory (not illustrated), and the control device 170 is configured to: execute the medium transport control program based on medium determination information from the medium type determiner 180; make appropriate nip pressure adjustment, for example, on the transport rolls 101 of the side transport path 90 and the transport rolls 102 of the vertical transport path 83; and transport media S with different thicknesses with an appropriate transport force so as to prevent the occurrence of wrinkles in the thin paper to be transported.

—Control Operation of Medium Transport Device—

Figure 6:
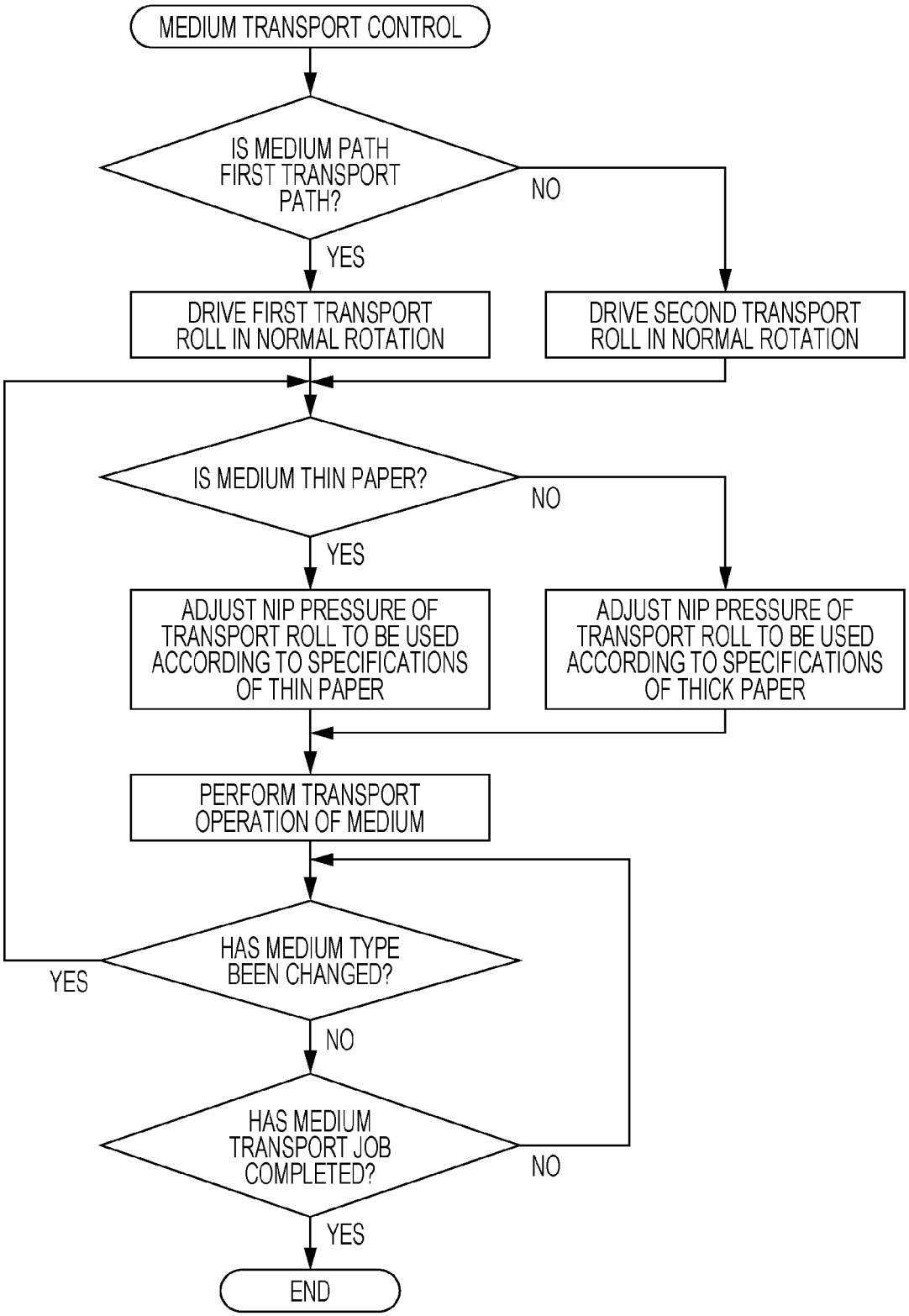
FIG. 6 is a flowchart illustrating the medium transport control by the medium transport device according to Exemplary Embodiment 1.

As illustrated in FIG. 6, the control device 170 first determines whether the first transport path 11 (corresponding to the side transport path 90 in this example) is used as a medium path. For example, when a medium is manually fed using the manual feed medium supply unit 92 as illustrated in FIG. 2, the control device 170 determines that the first transport path 11 is used. Conversely, when a medium is supplied using the medium supply containers 81, 82, the control device 170 determines that the first transport path 11 is not used, but the second transport path 12 (corresponding to the vertical transport path 83 in this example) is used.

When it is assumed that the first transport path 11 (the side transport path 90) is used, the first transport roll (the transport rolls 101 in this example) is driven in normal rotation by the first rotational drive mechanism 130. In contrast, when it is assumed that the second transport path 12 (the vertical transport path 83) is used, the second transport roll (the transport rolls 102 in this example) is driven in normal rotation by the second rotational drive mechanism 135.

Thereafter, the control device 170 determines whether the medium to be transported is predetermined thin paper based on the information from the medium type determiner 180.

When the medium to be transported is thin paper, the nip pressure of the transport rolls 101 or 102 to be used is adjusted according to thin paper specifications. On the other hand, when the medium to be transported is thick paper (including normal paper) other than thin paper, the nip pressure of the transport rolls 101 or 102 to be used is adjusted according to thick paper specifications.

Figure 7:
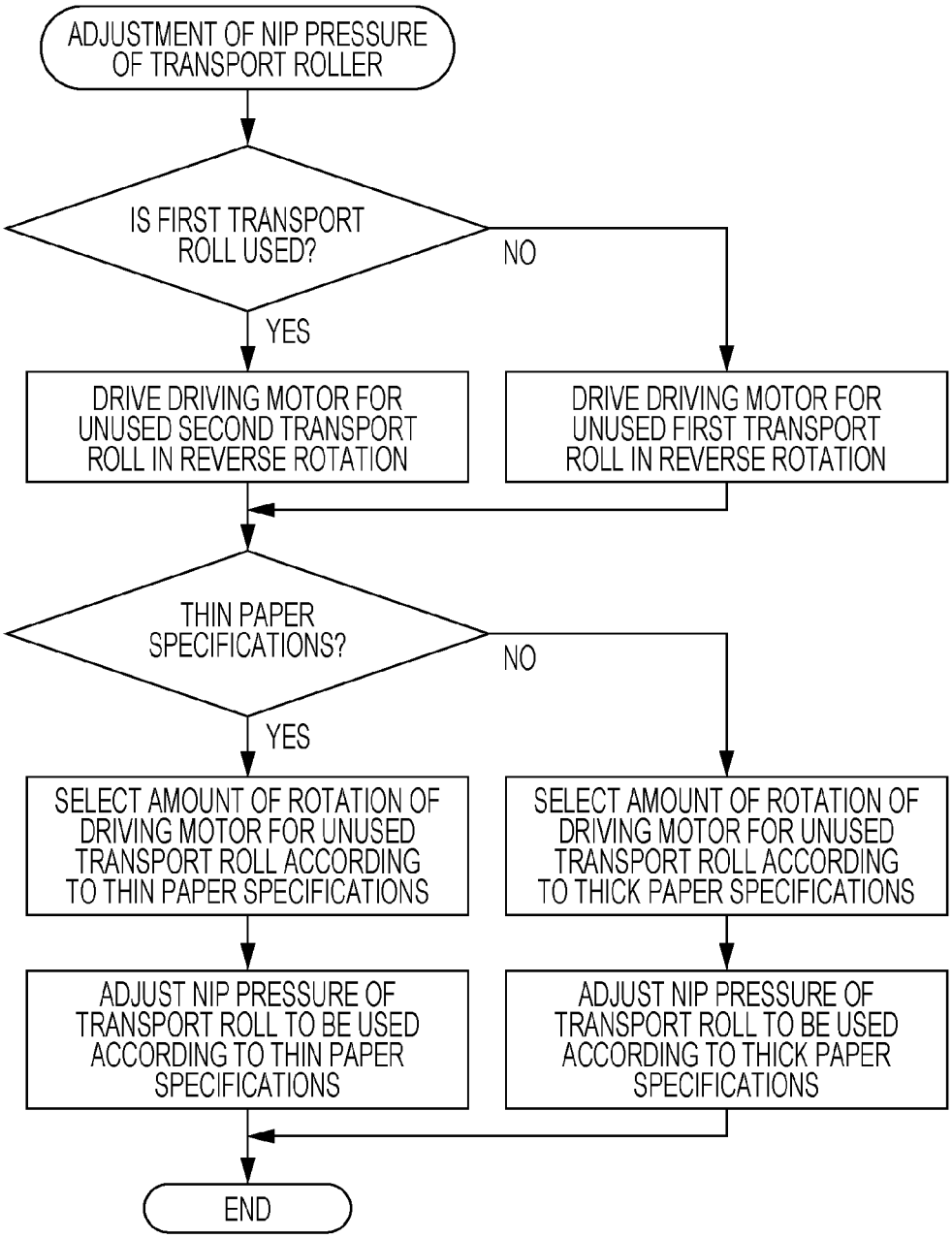
FIG. 7 is a flowchart illustrating an example of nip pressure adjustment for a transport roll illustrated in FIG. 6.

In this example, the nip pressure for the transport rolls 101 or 102 is adjusted, for example, in the manner as illustrated in FIG. 7.

In FIG. 7, the control device 170 determines whether the transport roll to be used is the first transport roll (the transport rolls 101), and when the first transport roll is used, causes the drive motor 136 of the unused second transport roll (the transport rolls 102) to be driven in reverse rotation. In contrast, when the second transport roll is used, the drive motor 131 of the unused first transport roll (the transport rolls 101) is driven in reverse rotation.

For nip pressure adjustment, the control device 170 determines based on the medium type to be used whether thin paper specifications are applied.

When thin paper specifications are applied, the amount of rotation of the unused transport roll is selected according to thin paper specifications. In contrast, when thick paper specifications are applied, the amount of rotation of the unused transport roll is selected according to thick paper specifications. In this example, in thin paper specifications, adjustment is made to a lower nip pressure, as compared to thick paper specifications.

Thereafter, when thin paper specifications are selected, the nip pressure of the transport rolls 101 or 102 to be used is adjusted according to thin paper specifications. In contrast, when thick paper specifications are selected, the nip pressure of the transport rolls 101 or 102 to be used is adjusted according to thick paper specifications.

After the nip pressure of the transport rolls 101 or 102 to be used is adjusted in this manner, a transport operation of the medium is performed as illustrated in FIG. 6.

When media with different thicknesses are mixed in the middle of performing a transport operation of a medium in one medium transport job, at the time of change of a medium type, an adjustment process is performed on the nip pressure of the transport rolls 101 or 102 to be used according to the medium type, then a transport operation of the medium is restarted.

Such an operation is repeated until the medium transport job is completed.

—Operation Example of Medium Transport Device—

<Operation Example Using First Transport Path>

Figure 8:
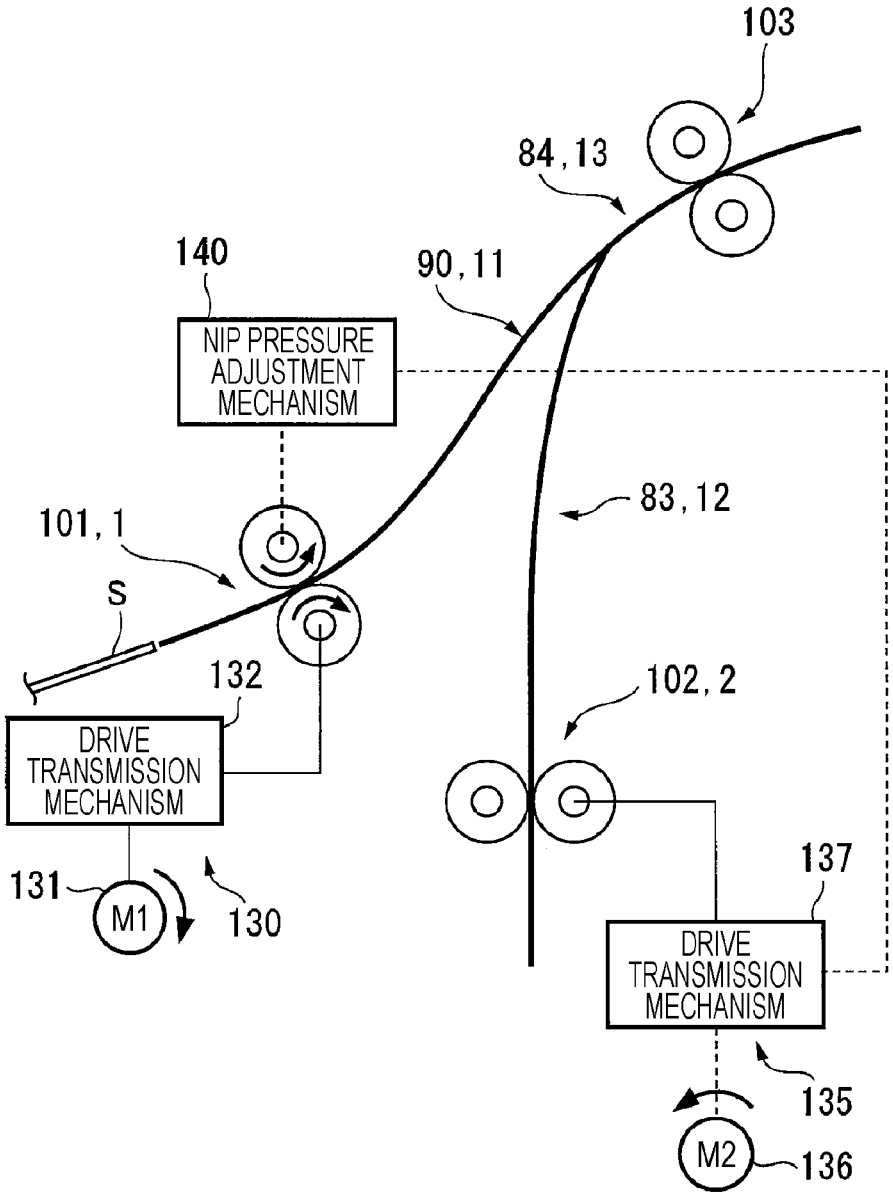
FIG. 8 is an explanatory view illustrating an operation example (1) of the medium transport device according to Exemplary Embodiment 1.

Now, as illustrated in FIG. 8, when the first transport path 11 (the side transport path 90) is used, the transport rolls 101 are driven in normal rotation by the first rotational drive mechanism 130, and the drive motor 136 of the second rotational drive mechanism 135 of the transport rolls 102 of the unused second transport path 12 (the vertical transport path 83) is utilized, then the nip pressure of the transport rolls 101 is adjusted according to the medium type. At this point, the drive motor 136 is driven in reverse rotation by the second rotational drive mechanism 135, and the driving force accompanying the drive in reverse rotation is transmitted to the nip pressure adjustment mechanism 140, and the nip pressure of the transport rolls 101 is adjusted. Note that at the time of reverse rotation drive of the drive motor 136, the transport rolls 102 is unused, thus the input-side transmission gear IN and the output-side transmission gear OUT of the drive transmission mechanism 137 are not drive-coupled.

<Operation Example Using Second Transport Path>

Figure 9:
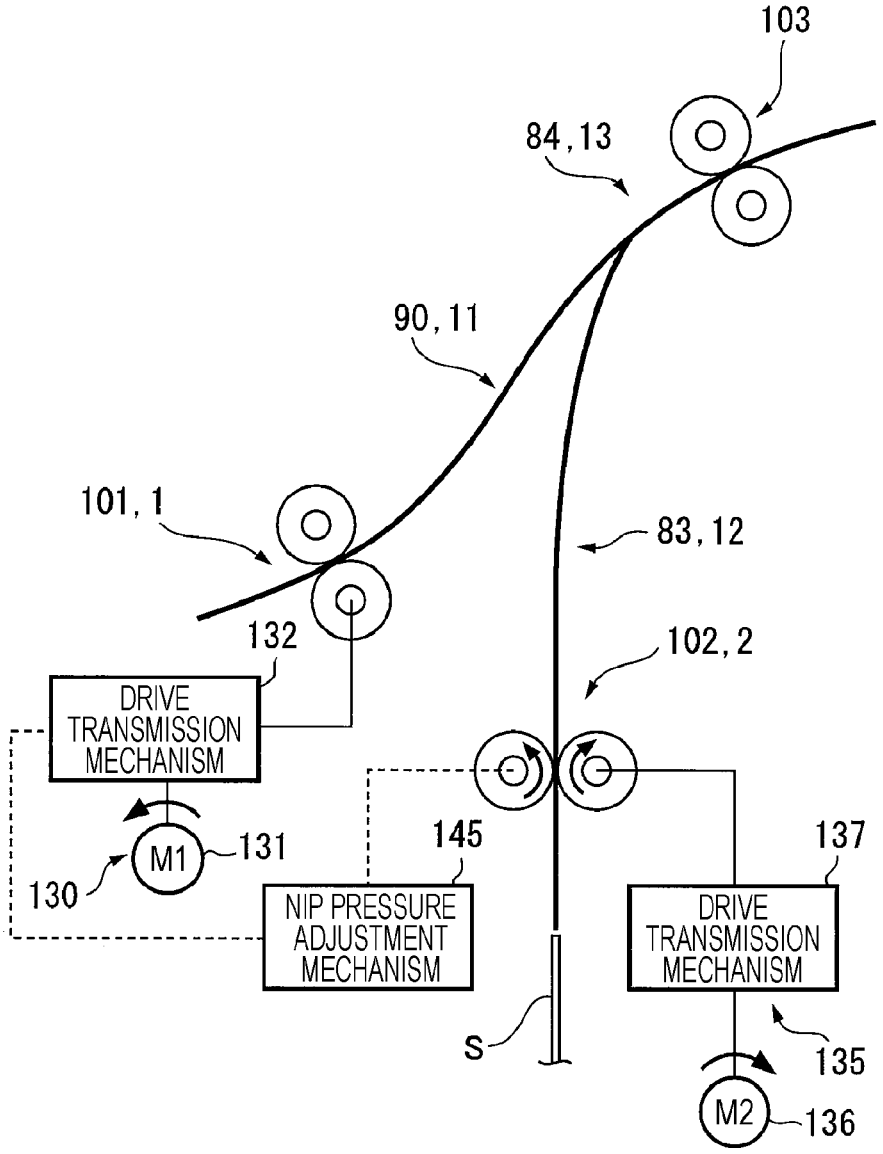
FIG. 9 is an explanatory view illustrating an operation example (2) of the medium transport device according to Exemplary Embodiment 1.

Now, as illustrated in FIG. 9, when the second transport path 12 (the vertical transport path 83) is used, the transport rolls 102 are driven in normal rotation by the second rotational drive mechanism 135, and the drive motor 131 of the first rotational drive mechanism 130 of the transport rolls 101 of the unused first transport path 11 (the side transport path 90) is utilized, then the nip pressure of the transport rolls 102 is adjusted according to the medium type. At this point, the drive motor 131 is driven in reverse rotation by the first rotational drive mechanism 130, and the driving force accompanying the drive in reverse rotation is transmitted to the nip pressure adjustment mechanism 145, and the nip pressure of the transport rolls 102 is adjusted. Note that at the time of reverse rotation drive of the drive motor 131, the transport rolls 101 are unused, thus the input-side transmission gear IN and the output-side transmission gear OUT of the drive transmission mechanism 132 are not drive-coupled.

Modification 1

Figure 10:
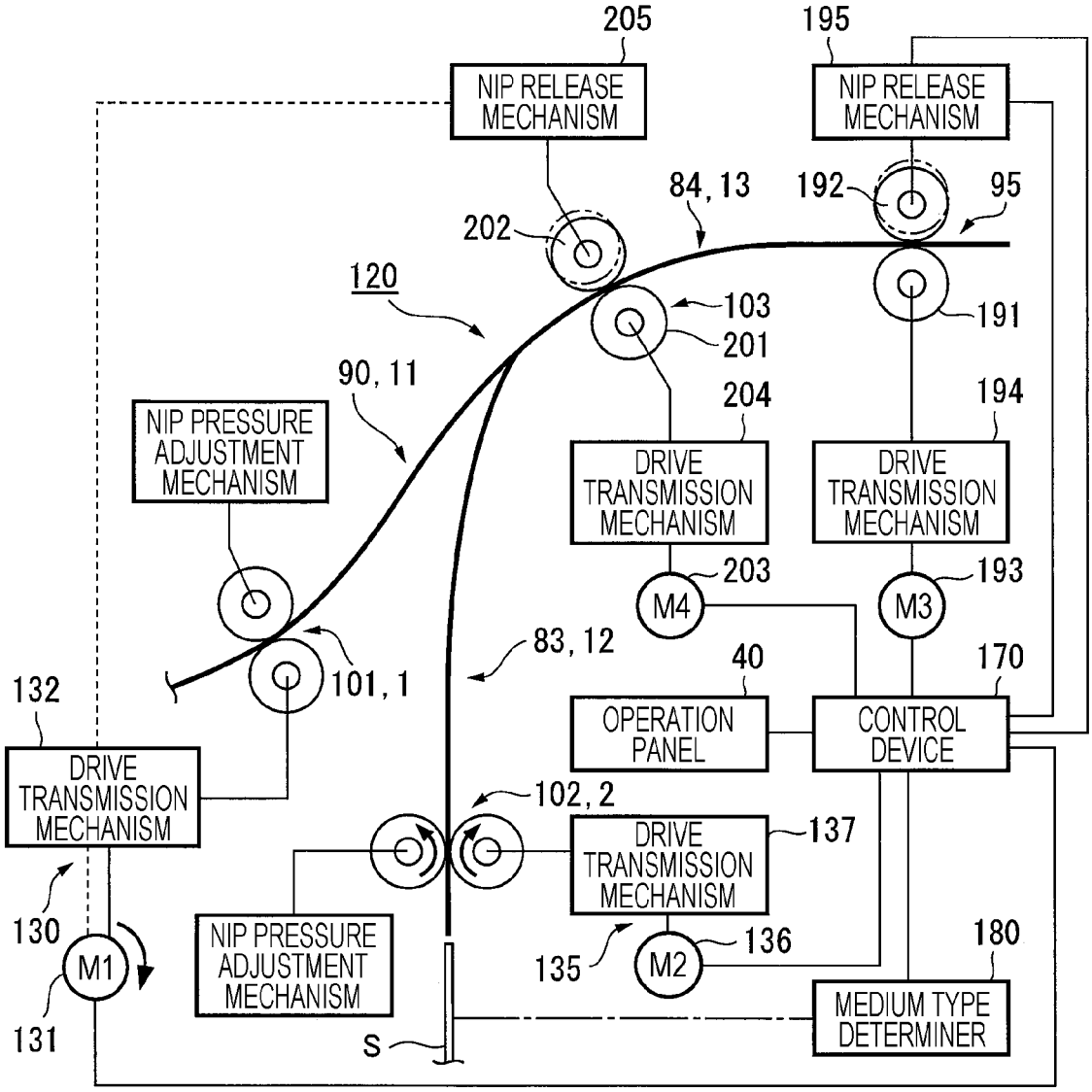
FIG. 10 is an explanatory view illustrating a major part of the medium transport device according to Modification 1.

FIG. 10 illustrates a medium transport device 120 according to Modification 1.

In FIG. 10, the basic configuration of the medium transport device 120 is approximately the same as the configuration of Exemplary Embodiment 1, and additionally, the present disclosure is also made applicable to the transport rolls 103 of the third transport path 13 (corresponding to the horizontal transport path 84) after the first transport path 11 (corresponding to the side transport path 90) and the second transport path 12 (corresponding to the vertical transport path 83) are merged downstream. Note that the same components as in Exemplary Embodiment 1 are labeled with the same symbol as in Exemplary Embodiment 1, and a detailed description is omitted.

In this example, the horizontal transport path 84 includes: the position alignment rolls 95 disposed forward of the second transfer region TR; and transport rolls 103 disposed forward of the position alignment rolls 95 and on a curved path portion formed immediately after the merge point of the side transport path 90 and the vertical transport path 83.

The position alignment rolls 95 include a drive roll 191, and a driven roll 192 that comes into contact with the drive roll 191 to be driven. The drive roll 191 is drive-coupled to a drive motor 193 (denoted as M3 in FIG. 10) via a drive transmission mechanism 194, the driven roll 192 is supported by a nip release mechanism 195, and is contactably and separably (nip release) moved to and from the drive roll 191 to form a contact area (nip area) to nip the medium S between the drive roll 192 and the drive roll 191, and is movable to a retract position away from the contact area.

In a similar manner to the position alignment rolls 95, the transport rolls 103 include a drive roll 201 and a driven roll 202, the drive roll 201 is drive-coupled to a drive motor 203 (denoted as M4 in FIG. 10) via a drive transmission mechanism 204, and the driven roll 202 is supported by a nip release mechanism 205.

In this example, when the tip end of the medium S is temporarily stopped for position alignment by the position alignment rolls 95, the medium S wound between the position alignment rolls 95 and the transport rolls 103 is deformed in an inverted U-shape, thus when the position alignment rolls 95 deliver the medium S after position alignment, the transport rolls 103 need to release the medium S by the nip release mechanism 205.

Particularly, in this example, since the transport rolls 103 are disposed near the transport rolls 101 of the side transport path 90, for example, the nip release mechanism 205 of the transport rolls 103 does not have a dedicated drive source, and has a similar configuration to that of the nip pressure adjustment mechanism 140 or 145, for example.

In this case, for example, when the transport rolls 101 of the side transport path 90 are not used for transport of the medium S, the drive motor 131 of the first rotational drive mechanism 130 is utilized, and in addition to adjustment of the nip pressure of transport rolls 103 according to the medium type, the shape of the cam members 151 is devised, thereby enabling a release operation for the driven roll 202 of the transport rolls 103.

In this situation, the drive motor 131 is driven in reverse rotation in the first rotational drive mechanism 130, the driving force accompanying the drive in reverse rotation is transmitted to the nip release mechanism 205, and the nip pressure of the transport rolls 103 is adjusted according to the medium type, and in addition, a release operation for the driven roll 202 is performed.

Note that in this example, the nip release mechanism 205 utilizes the drive motor 131 of the first rotational drive mechanism 130 of the transport rolls 101 as a drive source; however, for example, when the transport rolls 102 of the second transport path 12 is unused for transport of the medium S, the drive motor 136 of the second rotational drive mechanism 135 of the transport rolls 102 may be utilized as a drive source.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

APPENDIX (((1)))

A medium transport device comprising:

a first transport unit that is provided in a first transport path, and nips and transports a medium by a pair of rotating bodies;

a second transport unit that is provided in a second transport path different from the first transport path, and nips and transports a medium by a pair of rotating bodies;

a first rotation drive unit that rotationally drives the pair of rotating bodies of the first transport unit;

a second rotation drive unit that rotationally drives the pair of rotating bodies of the second transport unit; and a pressure contact force adjustment unit that is provided in at least one of the first transport unit or the second transport unit, and adjusts a pressure contact force of the pair of rotating bodies, wherein when one of the first transport unit or the second transport unit nips and transports the medium, the pressure contact force adjustment unit adjusts the pressure contact force of the one transport unit that nips and transports the medium by utilizing a drive source of a rotation drive unit that provides no driving force for transporting the medium to the first transport unit or the second transport unit.

(((2)))

The medium transport device according to (((1))), wherein when the medium is a thin medium with a thickness less than or equal to a predetermined thickness, the pressure contact force adjustment unit adjusts the pressure contact force to be lower than a pressure contact force for a medium other than the thin medium.

(((3)))

The medium transport device according to (((1))) or (((2))), wherein the pressure contact force adjustment unit adjusts the pressure contact force after the pair of rotating bodies of the first transport unit or the second transport unit start rotational drive.

(((4)))

The medium transport device according to any one of (((1))) to (((3))), wherein the pressure contact force adjustment unit adjusts the pressure contact force of both of the first transport unit and the second transport unit.

(((5)))

The medium transport device according to any one of (((1))) to (((4))), wherein the pressure contact force adjustment unit is configured to perform a nip release operation to nip and release the pair of rotating bodies between a contact position and a non-contact position.

(((6)))

The medium transport device according to any one of (((1))) to (((5))), wherein the pressure contact force adjustment unit has: a variable unit that is provided in the first transport unit or the second transport unit, and changes the pressure contact force; and a drive transmission unit that transmits, to the variable unit, a driving force of the drive source of the rotation drive unit that provides no driving force for transporting the medium to the first transport unit or the second transport unit.

(((7)))

The medium transport device according to (((6))), wherein the drive transmission unit has a rotational component to be rotated by the drive source, and the variable unit changes the pressure contact force with a cam member that rotates by following the rotational component.

(((8)))

The medium transport device according to (((6))), wherein the first rotation drive unit or the second rotation drive unit has the drive source that is normally and reversely rotatable, and the drive transmission unit includes an intermittently coupling component that, when the drive source of the first rotation drive unit or the second rotation drive unit drives in reverse rotation, transmits a driving force accompanying the drive in reverse rotation to the variable unit.

(((9)))

A medium processing apparatus comprising:

the medium transport device according to any one of (((1))) to (((8))); and a processing unit that performs a predetermined process on the medium transported by the medium transport device.

(((10)))

The medium processing apparatus according to (((9))), further comprising:

a positioning unit that positions the medium on a third transport path after the first transport path and the second transport path are merged downstream in a transport direction of the medium.

What is claimed is:

1. A medium transport device comprising:

a first transport unit that is provided in a first transport path, and nips and transports a medium by a pair of rotating bodies;

a second transport unit that is provided in a second transport path different from the first transport path, and nips and transports the medium by a pair of rotating bodies;

a first rotation drive unit having a drive source that rotationally drives the pair of rotating bodies of the first transport unit;

a second rotation drive unit having a drive source that rotationally drives the pair of rotating bodies of the second transport unit; and a pressure contact force adjustment unit having a variable unit that is provided in at least one of the first transport unit or the second transport unit, and adjusts a pressure contact force of the pair of rotating bodies, wherein the variable unit comprises a roller, wherein when one of the first transport unit or the second transport unit nips and transports the medium, the pressure contact force adjustment unit adjusts the pressure contact force of the one transport unit that nips and transports the medium by utilizing the drive source of one of the first rotation drive unit or the second rotation drive unit that provides no driving force for transporting the medium to the first transport unit or the second transport unit.

2. The medium transport device according to claim 1, wherein when the medium is a thin medium with a thickness less than or equal to a predetermined thickness, the pressure contact force adjustment unit adjusts the pressure contact force to be lower than a pressure contact force for a medium other than the thin medium.

3. A medium processing apparatus comprising:

the medium transport device according to claim 2; and a processing unit that performs a predetermined process on the medium transported by the medium transport device.

4. The medium processing apparatus according to claim 3, further comprising:

a positioning unit having a pair of rotating bodies that positions the medium on a third transport path after the first transport path and the second transport path are merged downstream in a transport direction of the medium.

5. The medium transport device according to claim 1, wherein the pressure contact force adjustment unit adjusts the pressure contact force after the pair of rotating bodies of the first transport unit or the second transport unit start rotational drive.

6. A medium processing apparatus comprising:

the medium transport device according to claim 5; and a processing unit that performs a predetermined process on the medium transported by the medium transport device.

7. The medium processing apparatus according to claim 6, further comprising:

a positioning unit having a pair of rotating bodies that positions the medium on a third transport path after the first transport path and the second transport path are merged downstream in a transport direction of the medium.

8. The medium transport device according to claim 1, wherein the pressure contact force adjustment unit adjusts the pressure contact force of both of the first transport unit and the second transport unit.

9. A medium processing apparatus comprising:

the medium transport device according to claim 8; and a processing unit that performs a predetermined process on the medium transported by the medium transport device.

10. The medium processing apparatus according to claim 9, further comprising:

a positioning unit having a pair of rotating bodies that positions the medium on a third transport path after the first transport path and the second transport path are merged downstream in a transport direction of the medium.

11. The medium transport device according to claim 1, wherein the pressure contact force adjustment unit is configured to perform a nip release operation to nip and release the pair of rotating bodies between a contact position and a non-contact position.

12. A medium processing apparatus comprising:

the medium transport device according to claim 11; and a processing unit that performs a predetermined process on the medium transported by the medium transport device.

13. The medium transport device according to claim 1, wherein the pressure contact force adjustment unit has a drive transmission unit that transmits, to the variable unit, a driving force of the drive source of the one rotation drive unit that provides no driving force for transporting the medium to the first transport unit or the second transport unit.

14. The medium transport device according to claim 13, wherein the drive transmission unit has a rotational component to be rotated by the drive source, and the variable unit changes the pressure contact force with a cam member that rotates by following the rotational component.

15. A medium processing apparatus comprising:

the medium transport device according to claim 14; and a processing unit that performs a predetermined process on the medium transported by the medium transport device.

16. The medium transport device according to claim 13, wherein the first rotation drive unit or the second rotation drive unit has the drive source that is normally and reversely rotatable, and the drive transmission unit includes an intermittently coupling component that, when the drive source of the first rotation drive unit or the second rotation drive unit drives in reverse rotation, transmits a driving force accompanying the drive in reverse rotation to the variable unit.

17. A medium processing apparatus comprising:

the medium transport device according to claim 16; and a processing unit that performs a predetermined process on the medium transported by the medium transport device.

18. A medium processing apparatus comprising:

the medium transport device according to claim 13; and a processing unit that performs a predetermined process on the medium transported by the medium transport device.

19. A medium processing apparatus comprising:

the medium transport device according to claim 1; and a processing unit that performs a predetermined process on the medium transported by the medium transport device.

20. The medium processing apparatus according to claim 19, further comprising:

a positioning unit having a pair of rotating bodies that positions the medium on a third transport path after the first transport path and the second transport path are merged downstream in a transport direction of the medium.

* * * * *